US012357892B2

(12) United States Patent
Goldstein

(10) Patent No.: US 12,357,892 B2
(45) Date of Patent: Jul. 15, 2025

(54) TENNIS SINGLE STICK WITH NET CABLE SUPPORT

(71) Applicant: Group One Limited, Ramsey (GB)

(72) Inventor: Fredric Goldstein, Nacka (SE)

(73) Assignee: Group One Limited, Ramsey (GB)

( * ) Notice: Subject to any disclaimer, the term of this patent is extended or adjusted under 35 U.S.C. 154(b) by 635 days.

(21) Appl. No.: 17/742,537

(22) Filed: May 12, 2022

(65) Prior Publication Data

US 2022/0370870 A1 Nov. 24, 2022

Related U.S. Application Data

(60) Provisional application No. 63/189,914, filed on May 18, 2021.

(51) Int. Cl.
*A63B 61/00* (2006.01)

(52) U.S. Cl.
CPC ..... *A63B 61/003* (2013.01)

(58) Field of Classification Search
CPC ..... A63B 61/003; A63B 61/04; F16B 2/20
See application file for complete search history.

(56) References Cited

U.S. PATENT DOCUMENTS

| | | | | | |
|---|---|---|---|---|---|
| 4,291,875 | A * | 9/1981 | Smith, Jr. | ..... | A63B 61/04 473/492 |
| 4,440,393 | A * | 4/1984 | Smith, Jr. | ..... | A63B 61/04 473/492 |
| 4,976,432 | A * | 12/1990 | Cheney | ..... | A63B 61/04 473/492 |
| 7,264,561 | B2 | 9/2007 | Scarpa, III et al. | | |
| 2013/0062489 | A1* | 3/2013 | DiNello | ..... | F16B 2/20 248/224.8 |
| 2022/0370870 | A1* | 11/2022 | Goldstein | ..... | A63B 61/04 |

FOREIGN PATENT DOCUMENTS

| | | | | | |
|---|---|---|---|---|---|
| CN | 100539341 | C * | 9/2009 | ..... | F16L 3/12 |
| CN | 108105221 | A * | 6/2018 | ..... | F16B 2/20 |
| EP | 1941825 | A2 * | 7/2008 | ..... | A47L 13/512 |
| KR | 200408477 | Y1 * | 2/2006 | | |
| KR | 20210020492 | A * | 2/2021 | | |

* cited by examiner

*Primary Examiner* — Raleigh W Chiu
(74) *Attorney, Agent, or Firm* — Carlson, Gaskey & Olds, P.C.

(57) ABSTRACT

In some aspects, the techniques described herein relate to a single stick for a net on a tennis court configured to maintain the net cord at its regulation height, including: a net cord support clip including a first portion configured to receive a net cord, and a second portion dimensioned such that the net cord remains within the first portion; and a single stick pipe, wherein the single stick pipe includes an open-topped channel, and wherein the net cord support clip is placed in the open-topped channel.

13 Claims, 5 Drawing Sheets

TENNIS SINGLE STICK WITH NET CABLE SUPPORT

RELATED APPLICATION(S)

This application claims the benefit of U.S. Provisional Application No. 63/189,914, filed May 18, 2021, the entirety of which is herein incorporated by reference.

BACKGROUND

On all tennis courts, perhaps the most integral part is the net. There are two main net posts placed at a pre-determined position (91.4 cm) outside the outermost sidelines of a tennis court. A tennis net is typically composed of a woven or plastic net configuration which allows one to see through to the other side of the court. This hangs from a strong metal cable or cord via a white "tape" which is attached to the net. The net cord/cable is attached to one post and then to the opposite post which has a crank that winds the cord/cable so that the net tightens and rises up to the required height and tension. In the middle of the net, there is a white mid strap which holds the net down by coming over the top of the net and being fastened to a clasp on the court surface.

For singles play, the net must also be a particular 107 cm height at 91.4 cm outside the outermost (singles) sideline. To achieve this, for virtually all courts (except a small number of professional "grand slam" tournament center courts), this is achieved by a pair of "single sticks," which are placed under the net at the 91.4 cm location during singles matches (during doubles matches, the net post themselves provide the 107 cm height at 91.4 cm from the outermost (doubles) lines).

The ITF Rules of Tennis also state that the single stick may not exceed 2.5 cm above the top of the net cord (i.e., the 107 cm height).

There are many different designs of single sticks. All of them, however, are configured to have a support at around 106.5 cm, whereupon the net cord (which is around 5 mm in thickness) will pass over at the height of 107 cm. There is then a structure which contributes to holding the net cord on the support during play, that is, blocks the net cord from slipping off.

SUMMARY

In some aspects, the techniques described herein relate to a single stick for a net on a tennis court, including: a net cord support clip including a first portion configured to receive a net cord, and a second portion dimensioned such that the net cord remains within the first portion; and a single stick pipe, wherein the single stick pipe includes an open-topped channel, and wherein the net cord support clip is placed in the open-topped channel.

In some aspects, the techniques described herein relate to a single stick, wherein the single stick pipe is made of wood.

In some aspects, the techniques described herein relate to a single stick, wherein: the net cord support clip includes first and second free ends and a curved end between the first and second free ends, the first and second free ends contact a bottom of the open-topped channel, and the curved end is adjacent a top of the open-topped channel.

In some aspects, the techniques described herein relate to a single stick, wherein: a semi-circular space including a diameter is beneath the curved end, and a gap is adjacent the semi-circular space, and within the gap, opposed sides of the net cord support clip are spaced apart by a lesser distance than the diameter.

In some aspects, the techniques described herein relate to a single stick, wherein the gap includes a spring-biased latch.

In some aspects, the techniques described herein relate to a single stick, wherein the gap is immediately below the semi-circular space.

In some aspects, the techniques described herein relate to a single stick, wherein a fastener is inserted into the gap.

In some aspects, the techniques described herein relate to a single stick, wherein the net cord support clip is provided by a single, integrally formed structure.

In some aspects, the techniques described herein relate to a single stick, wherein the net cord support clip is made of a metallic material.

In some aspects, the techniques described herein relate to a clip for use with a single stick for a net on a tennis court, including: first and second free ends and a curved end between the first and second free ends; a semi-circular section beneath the curved end, wherein the semi-circular section includes a diameter; and a reduced diameter section configured to hold a net cord above the reduced diameter section, wherein the diameter is greater than a distance between opposed sides of the clip within the reduced diameter section.

In some aspects, the techniques described herein relate to a clip, wherein: the first and second free ends are configured to contact a bottom of an open-topped channel of a single stick, and the curved end is configured to be positioned adjacent a top of the open-topped channel.

In some aspects, the techniques described herein relate to a clip, wherein the clip includes a fastener configured to selectively be inserted into the reduced diameter section.

DETAILED DESCRIPTION

Figure 1:
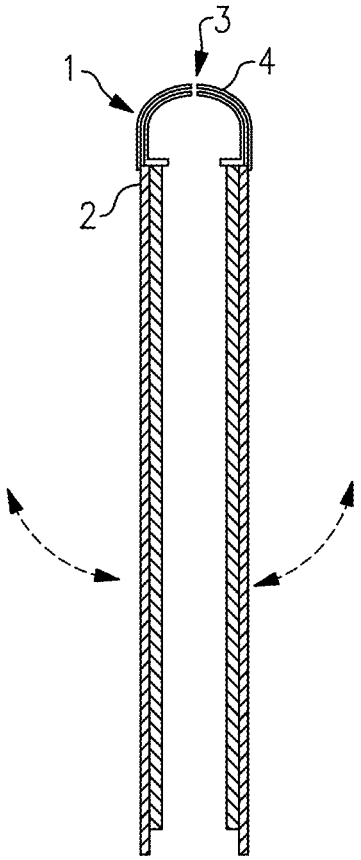
FIG. 1 is a side view of the example single stick net cord support.

Several exemplary single stick net cord supports are shown across the figures. In the first example, FIG. 1, a single stick support clip 1 includes a semi-circle 3, which is provided by relatively firm material, and which is bisected in two parts at hinge 4. This hinge allows the two halves to move apart to allow the insert of the net, and can be a traditional hinge or simply a strong flexible material (such as duct tape). The hinge 4 is shows as a gap but may instead be a solid piece of material connecting the two sides of the single stick support clip 1.

Wall 2 is a continuation of semi-circle 3. The wall 2 forms the outside of the single stick clip support 1. The wall 2 allows for a narrower passage than the area within semi-circle 3, and thus grips the net cord 5 in order to prevent it from moving downward. It will be appreciated that, under proper net tension, the force N pressing down upon the single stick is approximately between 70 to 100N, due to the angle created from the 107 cm height at the single stick to the center strap at 91.4 cm height 5.48 metres away. Therefore, a structure must be in place to block the net cord from being pulled downwards. The wall 2 may consist of one or more structures.

Figure 2:
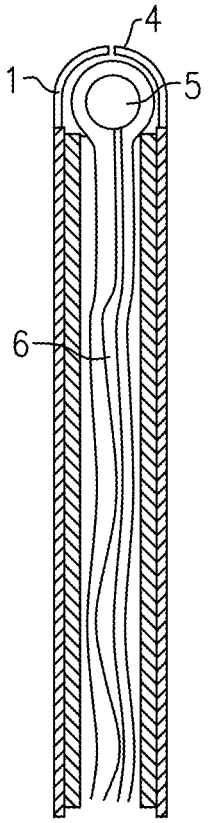
FIG. 2 is a side view of the example single stick net cord support with the net cord and net in place.

FIG. 2 shows a view illustrating the net cord 5 sitting inside the semi-circle 3, and prevented from slipping downward by wall 2. The net band 6 sits inside the support clip 1 in a gap between opposing faces of the wall 2.

This embodiment can as well be inserted into the slots of particular existing single sticks, after first inserting the net cord into the instant invention, thus complimenting existing singles sticks without needing a separate one. This would allow the net cord to sit within the slot of such a single stick at the correct 107 cm height, rather than slipping downward several centimeters and thus breaching the rules of tennis.

Figure 3:
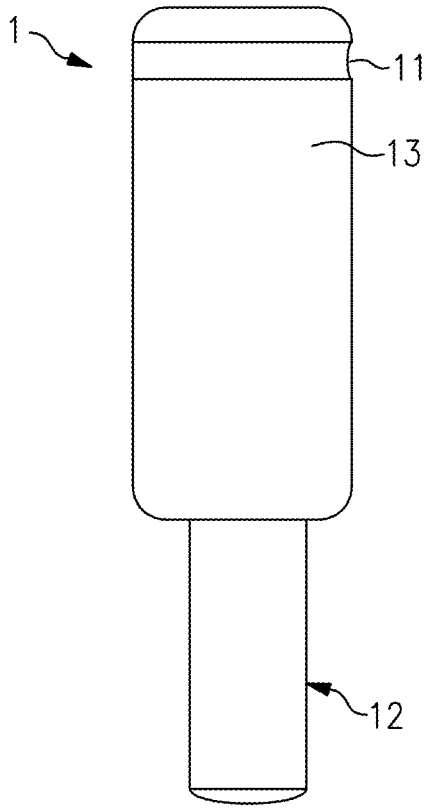
FIG.3 Prior Art
FIG. 3 is a front view of a prior art single stick net cord support with the insert.
Figure 4:
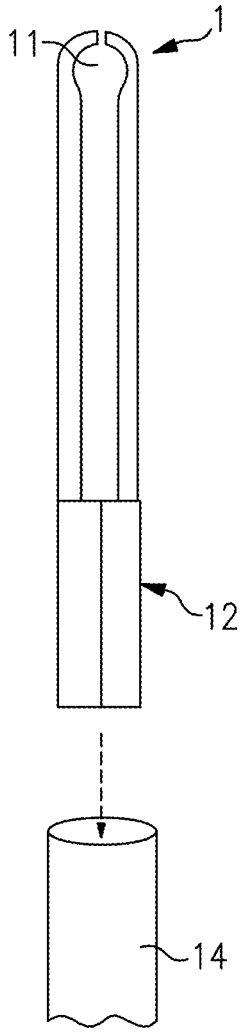
FIG.4 Prior Art
FIG. 4 is a side view of the prior art single stick net cord support with the insert, together with the single stick body.

FIGS. 3 and 4 illustrate a known, prior assembly. FIG. 3 shows a support clip portion 13. In one example, the support clip 1 is formed of two support clip portions 13, as shown in FIG. 4. Passage 11 forms a semi-circle that grips the net cord. Insert 12 is a fixed part of the support clip portion 13. As seen in FIG. 4, this is inserted into single stick body 14, a pipe which extends to the court surface, allowing the precise height of 107 cm. The clip opens, via hinge 4, to allow the placement of the net (net band), and is then closed. This firmly holds the net cord inside the semi-circle 11 (ensuring the correct 107 cm height). The two inserts 12 come together to effectively form a full circle, which match the single stick pipe 14 diameter, allowing insertion that will lock the support clip 1 in its closed position. The corresponding reverse force (due to the net band) will apply an outward pressure against the inner walls of single stick pipe 14, ensuring the support clip stays firmly inside. As such, it is effectively self-locking, without any requirement for further structure. Of course, a hinge is not required, but is preferable in keeping the two halves together as a unit.

In an alternative embodiment, threads can be present on both insert 12 and receiving threads on single stick pipe 14, so that the single stick pipe can be screwed into support clip 13. This has added benefits, including keeping the entire structure together when not in use, as well as allowing for a shorter insert 12 (making set up somewhat easier).

In yet another embodiment, the clip can include a spring biased latch that would lock in the net cord merely upon pressing the clip down on the net, allowing for just one side of the clip, and without need to have the clip and single stick body as separate units.

Figure 5:
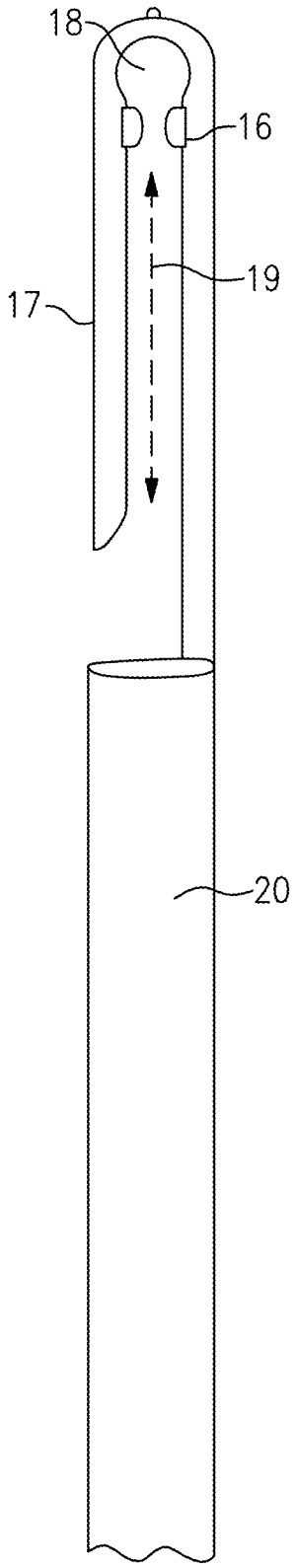
FIG. 5 illustrates another example single stick.
Figure 7:
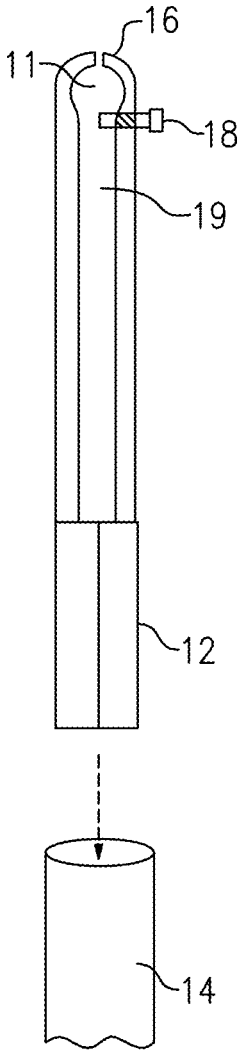
FIG. 7 is an example with a threaded fastener.

As seen in FIG. 5, a clip can provide a spring biased latch 16 that acts to grab the net cord, in lieu of the wall 17, whereby it completes the semi-circle 11, and thus prevents the net cord from slipping downwards. One side would be a part of the single stick pipe 20, while the second side wall 17 would be detached, allowing the entire single stick to be pressed downwards upon the net, the net sliding through passage 19, thus the net cord firmly grasped in the semi-circle 11 via the spring biased (or resilient) latch 16, and holding it at the required 107 cm height. Alternatively, the semi-circle 11 itself could be of a resilient flexible material that would allow it to open enough to detach the net cord when required, yet strong enough to hold together and block the net cord from sliding downwards into passage 19 (where it would be lower than the mandated 107 cm rule. As shown in FIG. 7, a threaded fastener 18 may project into the passage 19 adjacent the semi-circle 11 to prevent the net cord from sliding downwards beyond the threaded fastener 18.

Typically, the end of the pipe includes a flat platform in contact with the court surface, which stabilizes the vertical orientation of the single stick.

This disclosure provides an improved single stick that allows the net to be precisely 107 cm high at 91.4 cm beyond the singles line, prevents the band from being higher than 2.5 cm above the single stick, and has a more aesthetic clean look.

Figure 6A:
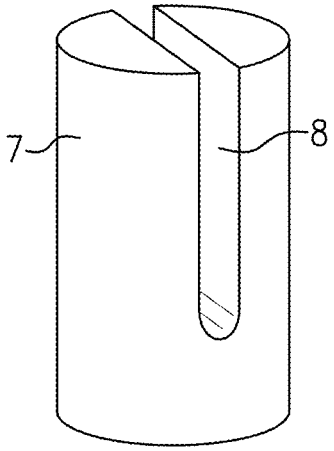
FIG. 6A is a perspective view of a top portion of another example single stick.

FIG. 6A illustrates from a perspective view a top portion of a known type of single stick, such as those traditionally used on grass court events like Wimbledon. Such single sticks have an iconic look. The single sticks 7, or single stick pipes, are typically made of wood and have a channel 8 extending from a top end of the stick downward. The channel 8 is an open-topped channel. During use, a net cord/cable and strap are arranged in the channel, and the white head band of the net will lie at the top of the 107 cm height of the single stick, creating an aesthetically pleasing look. However, under several pounds of downward force from the net tension, the net cord itself (which is the basis for the 107 cm height regulation) may move toward the bottom of the channel 8. This is not desirable, as it breaches the rules of tennis because the net is no longer held at the correct regulation height. The discrepancy in height can be as much as two inches (4-5 cm) too low.

Figure 6B:
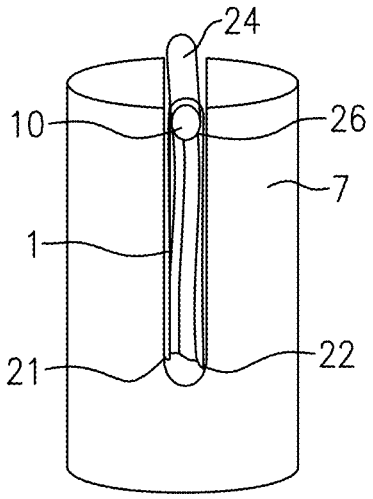
FIG. 6B is a side view of the example single stick of FIG. 6B with a clip arranged in a channel thereof.
Figure 6C:
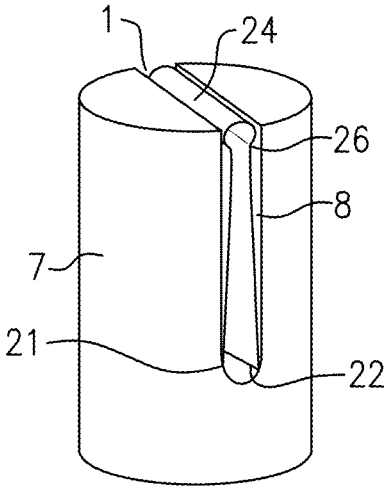
FIG. 6C is another view of the arrangement of FIG. 6B.

In this disclosure, a clip 1 is inserted into the channel 8, as shown in FIGS. 6B and 6C. The clip 1 in this example is primary a single, unitary structure formed of a piece of metallic material, as an example. The clip 1 exhibits a height corresponding to the height of the channel 8, a length corresponding to the length of the channel 8, and a width corresponding to the width of the channel 8. When outside the channel 8, the clip 1 moves under its own resilience to a relaxed position in which the clip 1 exhibits a width slightly greater than the channel 8. The clip 1 includes first and second free ends 21, 22. When pinched toward one another, the clip 1 is configured such that the width of the clip 1 is slightly less than the width of the channel 8, such that the clip 1 can be inserted into the channel 8 as shown in FIG. 6B. When inserted fully into the channel 8, the first and second free ends 21, 22 contact a bottom of the channel 8. Opposite the free ends, the clip 1 includes a curved end 24 formed by a bend in the clip 1. Between the curved end 24 and the free ends 21, 22, and more specifically immediately below the semi-circular section defined beneath the curved end 24, the clip 1 includes a reduced diameter section 26. Within the reduced diameter section 26, a dimension between opposed sides of the clip 1 is less than a diameter within the semi-circular section immediately above the reduced diameter section 26. In this way, the opposing sides of the clip 1 are relatively close to one another at the reduced diameter section 26, such that the net cord is retained above the reduced diameter section 26 and within the semi-circular section beneath the curved end 24. In particular, beginning at the curved end 24, the sides of the clips gradually move further away from one another and then gradually back toward one another at the reduced diameter section 26. From the reduced diameter section 26 on down to the free ends, the sides gradually move further away from one another again, although the sides may be substantially parallel to one another beneath the reduced diameter section 26.

Above the reduced diameter section 26, the clip 1 is configured to hold a net cord. In particular, the reduced diameter section 26 prevents the net cord from falling below the reduced diameter section 26 and approaching the bottom of the channel 8. The arrangement of the clip 1 beneath the reduced diameter section 26 does not interfere with the strap, which fits between the sides of the clip 1. With this disclosure, the net cord is held at the top of the 107 cm single stick, thus adhering to the rules of tennis that the net cord shall pass over at a height of 107 cm.

In the embodiment of FIGS. 6B and 6C, the clip 1 is integrally formed of a single piece of material, such as a metallic material or a hard plastic. To set up the net, the clip 1 is arranged about a net cord, the sides of the clip are pinched together and inserted into the channel 8, in one example. The clip 1 is arranged such that the sides hold the clip 1 in the channel 8, although the clip 1 could be held in the channel in other ways.

Accordingly, the arrangement of FIGS. 6B and 6C holds the net at the correct height. Further, the clip 1 is arranged substantially, if not fully, within the channel 8 such that spectators do not notice it. Thus, the clip 1 does not detract from the iconic look of the single stick 7. A fastener, such as fastener 18, could be incorporated into the embodiment of FIGS. 6B, 6C to provide additional support to keep the net cord above the reduced diameter section 26.

Alternatively, the clip can be attached, either permanently or otherwise, to the net at the proper location of 91.4 cm outside the singles line by use of a fastener. This fastener may also act to pinch the clip 1 together right below the net cord, thus further locking within the reduced diameter 26 to ensure it is held at regulation height. The fastener may comprise a screw which can be turned to move inwards at the start of a tournament, left in place throughout, and then easily unscrewed for removal. Once the clip is attached, the single stick is then inserted so that the clip and net cord rise up to regulation height. This not only ensures the net cord remains firmly at the vertical regulation height, it also ensures that it is placed at the regulation lateral 91.4 cm location outside the singles lines. Further, it allows for a quicker set up as only the usual single stick need be inserted/removed. Finally, it will prevent the misplacement or loss of the clip as it remains attached to the net. As the clip will blend into the head band of the net, it will be virtually invisible even when not in use during doubles matches (when single sticks are not used).

Although the different examples have the specific components shown in the illustrations, embodiments of this claimed invention are not limited to those particular combinations. It is possible to use some of the components or features from one of the examples in combination with features or components from another one of the examples. Furthermore it is appreciated that distances or features in the drawings may be reduced or exaggerated for illustrative purposes and do not in any way so limit the embodiment shown. It is further noted that different descriptions and names may be employed for various parts, and may be interchangeable (such as net cord and metal cable), and do not limit the scope of the invention. Furthermore, references to specific measurements, such as 107 cm and 91.4 cm heights, are to be used solely to illustrate the goals to be achieved (i.e. adhering to the rules of tennis) and should not be construed as limiting the invention to that precise height.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A single stick for a net on a tennis court, comprising:

a net cord support clip including a first portion configured to receive a net cord, and a second portion dimensioned such that the net cord remains within the first portion; and a single stick pipe, wherein the single stick pipe includes an open-topped channel, and wherein the net cord support clip is arranged in the open-topped channel, wherein the net cord support clip includes first and second free ends and a top end on a generally opposite end of the net cord support clip as the first and second free ends, wherein the first and second free ends are adjacent a bottom of the open-topped channel, and wherein the top end is adjacent a top of the open-topped channel.

2. The single stick as recited in claim 1, wherein the single stick pipe is made of wood.

3. The single stick as recited in claim 1, wherein:

a semi-circular space including a diameter is beneath the top end, and a gap is adjacent the semi-circular space, and within the gap, opposed sides of the net cord support clip are spaced apart by a lesser distance than the diameter.

4. The single stick as recited in claim 3, wherein the gap is immediately below the semi-circular space.

5. The single stick as recited in claim 1, wherein the net cord support clip is provided by a single, integrally formed structure.

6. The single stick as recited in claim 1, wherein the net cord support clip is made of a metallic material.

7. The single stick as recited in claim 1, wherein the net cord support clip is configured to exhibit a relaxed position when the net cord support clip is removed from the open-topped channel, and wherein, in the relaxed position, the first and second free ends are spaced-apart from one another by a distance greater than a width of the open-topped channel.

8. The single stick as recited in claim 1, wherein a substantial entirety of the net cord support clip is arranged within the open-topped channel.

9. The single stick as recited in claim 8, wherein an entirety of the net cord support clip is arranged within the open-topped channel.

10. The single stick as recited in claim 1, wherein the top end is provided by a curved end of the net cord support clip.

11. A single stick for a net on a tennis court, comprising:

a net cord support clip including a first portion configured to receive a net cord, and a second portion dimensioned such that the net cord remains within the first portion;

a single stick pipe, wherein the single stick pipe includes an open-topped channel, and wherein the net cord support clip is arranged in the open-topped channel;

wherein the net cord support clip includes first and second free ends and a curved end between the first and second free ends, wherein the first and second free ends contact a bottom of the open-topped channel, wherein the curved end is adjacent a top of the open-topped channel, wherein a semi-circular space including a diameter is beneath the curved end, and a gap is adjacent the semi-circular space, wherein, within the gap, opposed sides of the net cord support clip are spaced apart by a lesser distance than the diameter, and wherein the gap includes a spring-biased latch.

12. A single stick for a net on a tennis court, comprising:

a net cord support clip including a first portion configured to receive a net cord, and a second portion dimensioned such that the net cord remains within the first portion;

a single stick pipe, wherein the single stick pipe includes an open-topped channel, and wherein the net cord support clip is arranged in the open-topped channel;

wherein the net cord support clip includes first and second free ends and a curved end between the first and second free ends, wherein the first and second free ends contact a bottom of the open-topped channel, wherein the curved end is adjacent a top of the open-topped channel, wherein a semi-circular space including a diameter is beneath the curved end, and a gap is adjacent the semi-circular space, wherein, within the gap, opposed sides of the net cord support clip are spaced apart by a lesser distance than the diameter, and wherein a fastener is arranged adjacent the gap and is configured to be inserted into the gap.

13. The single stick as recited in claim 12, wherein the fastener is configured such that rotation of the fastener in a first direction advances the fastener into the gap, and rotation of the fastener in a second direction opposite the first direction retracts the fastener from the gap.

* * * * *